US005865253A

United States Patent [19]

Gamper et al.

[11] Patent Number: 5,865,253

[45] Date of Patent: Feb. 2, 1999

[54] WELLBORE OVERSHOT

[75] Inventors: Joseph W. Gamper; Brian Garduno, both of Rock Springs, Wyo.

[73] Assignee: Weatherford/Lamb, Inc.

[21] Appl. No.: 831,625

[22] Filed: Apr. 9, 1997

(Under 37 CFR 1.47)

[51] Int. Cl.[6] ..... E21B 31/18

[52] U.S. Cl. ..... 166/301; 166/98; 294/86.31

[58] Field of Search ..... 166/88, 301; 294/86.26, 294/86.3, 86.31

[56] References Cited

U.S. PATENT DOCUMENTS

| | | | |
|---|---|---|---|
| 264,930 | 9/1882 | Conradson . | |
| 529,781 | 11/1894 | Craelius . | |
| 885,478 | 4/1908 | Hollingsworth . | |
| 1,351,744 | 9/1920 | Dailey . | |
| 1,428,385 | 9/1922 | Meredith et al. . | |
| 1,487,440 | 3/1924 | Butts | 294/86.26 |
| 1,524,288 | 1/1925 | Burns . | |
| 1,581,010 | 4/1926 | Murray . | |
| 1,592,337 | 7/1926 | Cailloux et al. . | |
| 1,592,981 | 7/1926 | Ligon | 294/86.21 |
| 1,599,067 | 9/1926 | Segelhorst . | |
| 1,601,369 | 9/1926 | Montgomery . | |
| 1,616,024 | 2/1927 | Brust, Jr. . | |
| 1,664,461 | 4/1928 | Montgomery . | |
| 1,720,692 | 7/1929 | Reynolds et al. . | |
| 1,728,781 | 9/1929 | Cameron | 294/86.3 X |
| 1,732,962 | 10/1929 | Brust, Jr. . | |
| 1,778,968 | 10/1930 | Towne . | |
| 1,791,529 | 2/1931 | Lamoureux et al. | 294/86.3 X |
| 1,920,617 | 8/1933 | Young et al. . | |
| 2,014,804 | 9/1935 | Hinderliter | 294/86.21 |
| 2,067,009 | 1/1937 | Hinderliter . | |
| 2,174,077 | 9/1939 | Bowne . | |
| 2,201,434 | 5/1940 | Gallagher . | |
| 2,245,571 | 6/1941 | Chappell . | |
| 2,275,911 | 3/1942 | LeBus . | |
| 2,313,263 | 3/1943 | Rea . | |
| 2,492,813 | 12/1949 | Osmun . | |
| 2,553,985 | 5/1951 | Siracusa . | |
| 2,567,337 | 9/1951 | Hunt . | |
| 2,595,008 | 4/1952 | Sill . | |
| 2,616,752 | 11/1952 | Osmun | 294/86.3 X |
| 2,743,130 | 4/1956 | Osmun . | |
| 2,852,301 | 9/1958 | Gentry . | |
| 2,970,859 | 2/1961 | Justice . | |
| 3,191,981 | 6/1965 | Osmun . | |
| 3,358,765 | 12/1967 | LeBlanc . | |
| 3,422,524 | 1/1969 | Timmons . | |
| 3,527,494 | 9/1970 | Young | 294/86.31 X |
| 3,590,921 | 7/1971 | Brunjes . | |
| 3,608,932 | 9/1971 | Brown . | |
| 3,698,756 | 10/1972 | Groves . | |
| 4,124,245 | 11/1978 | Kuenzel . | |
| 4,138,145 | 2/1979 | Lawrence . | |

(List continued on next page.)

OTHER PUBLICATIONS

Homco Casing Bowl, Composite Catalog, 1970—71, p. 2535.

Web Wilson Champion Elevators, Joy Petroleum Equipment Brochure 875, 1975.

Oversocket Fishing Tool, Bull Dog, Inc., 1996—97 Composite Catalog.

*Primary Examiner*—George Suchfield
*Attorney, Agent, or Firm*—Guy McClung

[57] ABSTRACT

An overshot for engaging and retrieving a collapsed coiled tubing in a wellbore, has been invented. In one aspect the overshot has a body member with a top, a bottom, and a body channel therethrough from top to bottom, the body member having a slip chamber, at least one slip movably disposed in the slip chamber of the body member, and movable on at least one inclined rail in the slip chamber so that, upon contacting the collapsed coiled tubing, upward movement of the body member results in downward movement of the at least one slip which also moves the at least one slip inwardly in the body member thereby increasing gripping force of the at least one slip on the collapsed coiled tubing. Methods have also been invented for using such overshots.

8 Claims, 2 Drawing Sheets

U.S. PATENT DOCUMENTS 5,054,832 10/1991 Davis et al. .
5,409,065 4/1995 Davis .
5,413,171 5/1995 Womack ..... 166/98
5,580,114 12/1996 Palmer .
5,765,638 6/1998 Taylor ..... 166/98

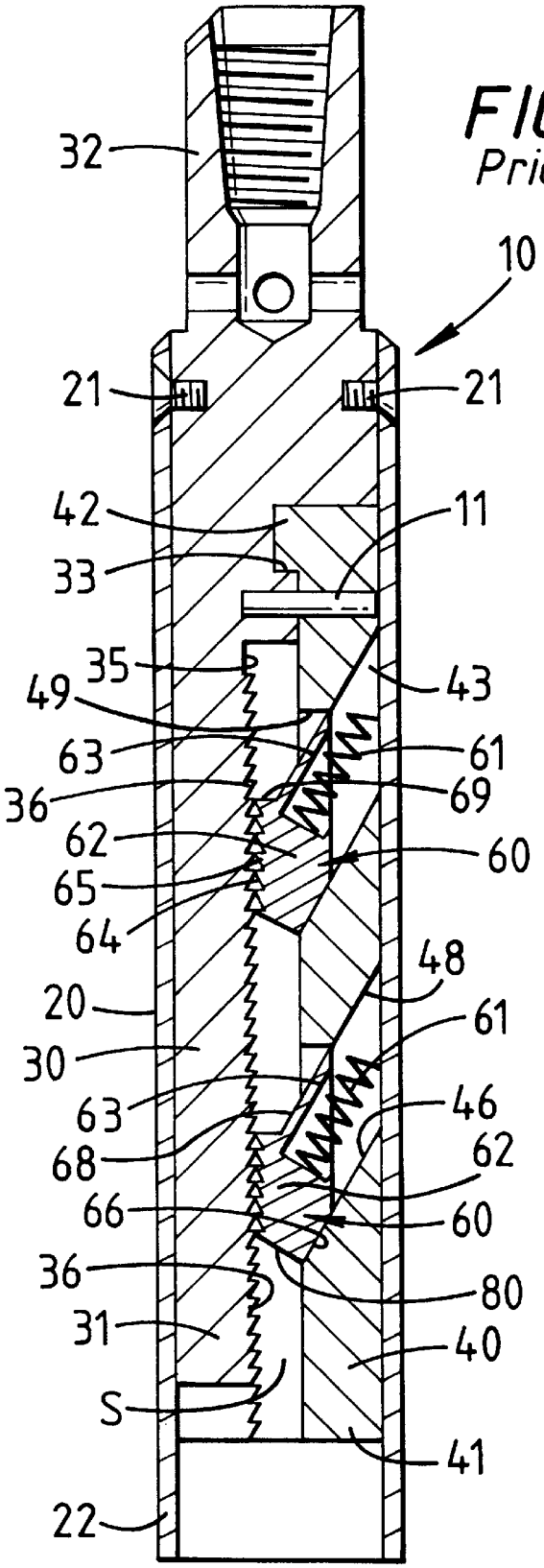
FIG. 1
Prior Art.
FIG. 2C
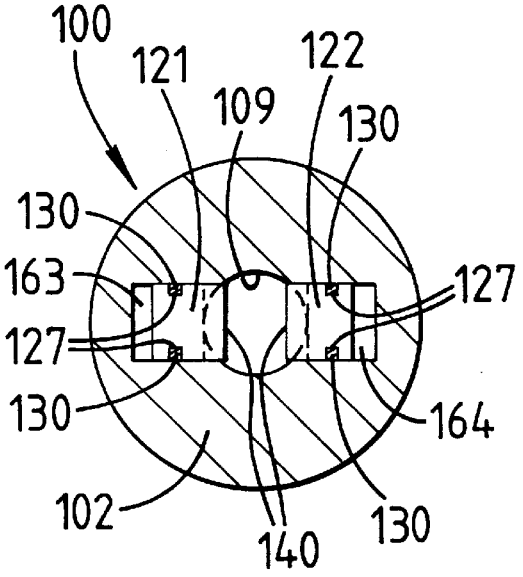

WELLBORE OVERSHOT

BACKGROUND OF THE INVENTION

1. Field of the Invention

The present invention is directed to wellbore overshots and, in one particular aspect, to overshots for tubing. In one specific embodiment the present invention is directed to an overshot for engaging and retrieving collapsed coiled tubing.

2. Description of Related Art

The prior art discloses a wide variety of wellbore overshots for engaging and retrieving tubulars and other "fish" used in a wellbore. Often in using coiled tubing, the tubing collapses. There has long been a need for an overshot useful in a wellbore to effectively engage and retrieve collapsed coiled tubing.

FIG. 1 shows a prior art overshot 10 with an outer cover sleeve 20, a mandrel 30 disposed substantially within the cover sleeve 20, and a body member 40 disposed within the cover sleeve 20 opposite the mandrel 30. One or more set screws 21 secures the mandrel 30 within the cover sleeve 20. A lower end 22 of the cover sleeve 20 projects down below a lower end 31 of the mandrel 30 and a lower end 41 of the body member 40. Preferably the lower end 22 of the cover sleeve is sized and disposed for encompassing a top of collapsed coiled tubing or of a fish. A top end 32 of the mandrel 30 has a threaded portion for releasably connecting the overshot to a work string. The body member 40 has an upper shoulder 42 that abuts a lower shoulder 33 of the mandrel 30. An alignment pin 11 extends through the body member 40 and the mandrel 30. A plurality of slips 60 are each movably disposed in a corresponding slip channel 43 of the body member 40. A spring 61 biases each slip downwardly. A portion of each spring 61 extends through a spring channel 63 in each slip body 62. The mandrel 30 has an inner wall 35 with upwardly directed teeth 36. Each slip 60 has an outer surface 64 with upwardly directed teeth 65. The inner wall 35 of the mandrel 30 and an inner wall 45 of the body member 40 define a space S into which part of a fish or coiled tubing may project for gripping between the mandrel 30 and the slips 60. Each slip 60 has a lower inclined surface 66 which corresponds to and rides on a lower inclined surface 46 of each slip channel 43 of the body member 40. Each slip 60 has an upper inclined surface 68 which corresponds to and rides against an upper inclined surface 48 of the slip channels 43. Each slip 60 has a lower inclined surface 80 against which a fish or tubing may push or be pushed to push the slip up in its slip channel thereby permitting the fish or tubing to enter into the space S between a slip and the inner wall of the mandrel so that the fish or tubing may be gripped therebetween. The slips are sized so that they cannot exit their slip channels into the space S and cannot fall out of the overshot. A shoulder 69 of each slip abuts a shoulder 49 of the body member to prevent further upward slip movement. A pointed end 37 of the mandrel 30 and a pointed end 47 of the body member 40 facilitate reception of a fish or tubing within the overshot and movement of the fish or tubing into the space S.

SUMMARY OF THE PRESENT INVENTION

The present invention, in certain embodiments, discloses an overshot apparatus for engaging and retrieving tubulars. In one aspect, such an apparatus is useful with collapsed coiled tubing.

The present invention, in certain embodiments, discloses an overshot for engaging and retrieving a collapsed coiled tubing in a wellbore, the overshot having a body member with a top, a bottom, and a body channel therethrough from top to bottom, the body member having at least one slip chamber, at least one slip movably disposed in the at lest one slip chamber of the body member, the at least one slip movable on at least one inclined rail in the at least one slip chamber so that, upon contacting the collapsed coiled tubing, upward movement of the body member results in downward movement of the at least one slip which also moves the at least one slip inwardly in the body member thereby increasing gripping force of the at least one slip on the collapsed coiled tubing; such an overshot wherein the at least one slip is two opposed slips, a first slip and a second slip opposite the first slip, each slip in a slip chamber in the body member, each slip movably mounted on at least one inclined rail; such an overshot wherein the at least one slip is a third slip and a fourth slip opposite the third slip, each in a slip chamber in the body member and movably mounted on at least one inclined rail, the third and fourth slips lower than the first and second slips; any such overshot with a bearing body connected to the body member, the bearing body rotatably connectible to another member between the body member and the another member; such an overshot wherein the at least one slip has a toothed outer gripping surface to facilitate gripping of the collapsed coiled tubing.

In certain aspects, the present invention discloses an overshot for engaging and retrieving a collapsed coiled tubing in a wellbore, the overshot having a body member with a top, a bottom, and a body channel therethrough from top to bottom, the body member having four slip chambers, two pairs of slips, one pair above the other, each slip movably disposed in the slip chamber of the body member, each slip movable on two inclined rails in its slip chamber so that, upon contacting the collapsed coiled tubing, upward movement of the body member results in downward movement of the slips which also moves the slips inwardly in the body member thereby increasing gripping force of the slips on the collapsed coiled tubing, and each slip removably held in its respective slip chamber by a releasable stop member, and each slip having a toothed outer gripping surface to facilitate gripping of the collapsed coiled tubing.

In certain aspects, the present invention discloses a method for engaging collapsed coiled tubing in a wellbore with an overshot, the method including introducing an overshot into a wellbore to contact the collapsed coiled tubing in the wellbore, the overshot having a body member with a top, a bottom, and a body channel therethrough from top to bottom, the body member having two slip chambers, two slips each movably disposed in each slip chamber of the body member, each slip movable on an inclined rail in a corresponding slip chamber so that, upon contacting the tubing, upward movement of the body member results in downward movement of the slips which also moves the slips inwardly in the body member thereby increasing gripping force of the slips on the collapsed coiled tubing, engaging the tubing with the overshot, and removing the overshot and tubing from the wellbore; such a method wherein a hollow sub is connected to the top of the overshot for receiving a portion of the collapsed coiled tubing and the method also including receiving a portion of the collapsed coiled tubing in the hollow sub.

It is, therefore, an object of at least certain preferred embodiments of the present invention to provide:

New, useful, unique, efficient, nonobvious wellbore overshot devices and methods for their use;

Such an overshot which effectively engages and holds coiled tubing;

Such an overshot which effectively engages and holds crushed or collapsed coiled tubing; and Such an overshot which has one or more movable slips for engaging and securing coiled tubing.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1 is a side view in cross-section of a prior overshot.

FIG. 2C is a top cross-section view of the overshot of FIG. 2A.

DESCRIPTION OF EMBODIMENTS PREFERRED AT THE TIME OF FILING FOR THIS PATENT

Figure 2A:
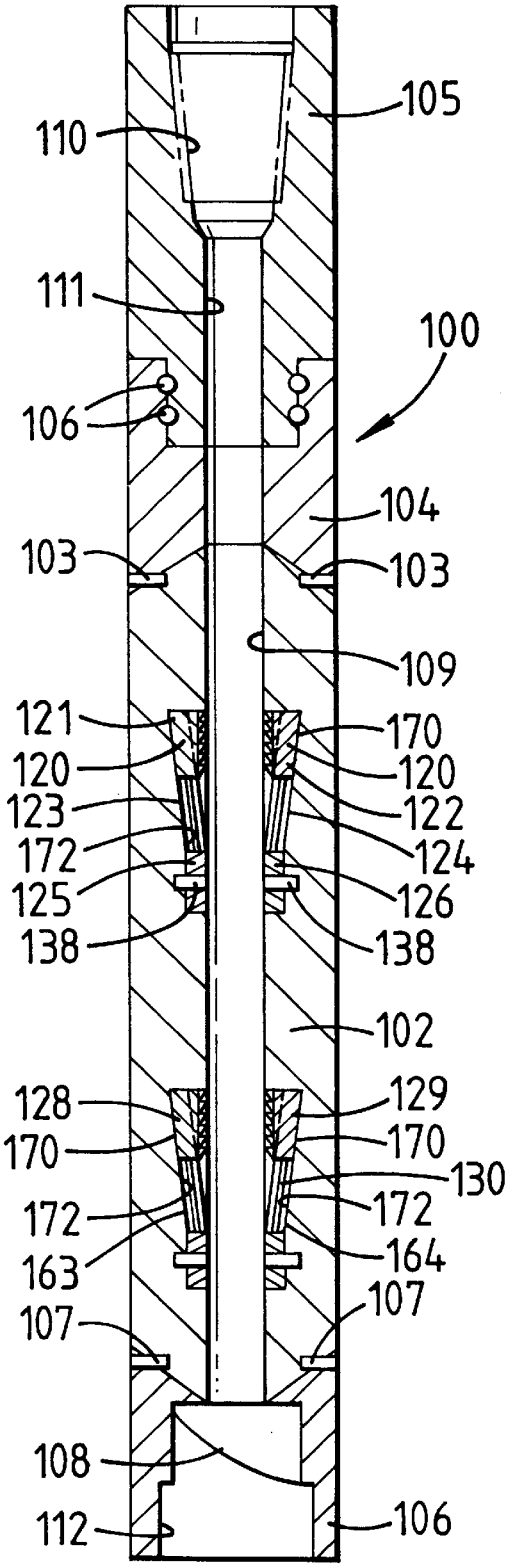
FIGS. 2A and 2B are side views in cross-section of an overshot according to the present invention.
Figure 2B:
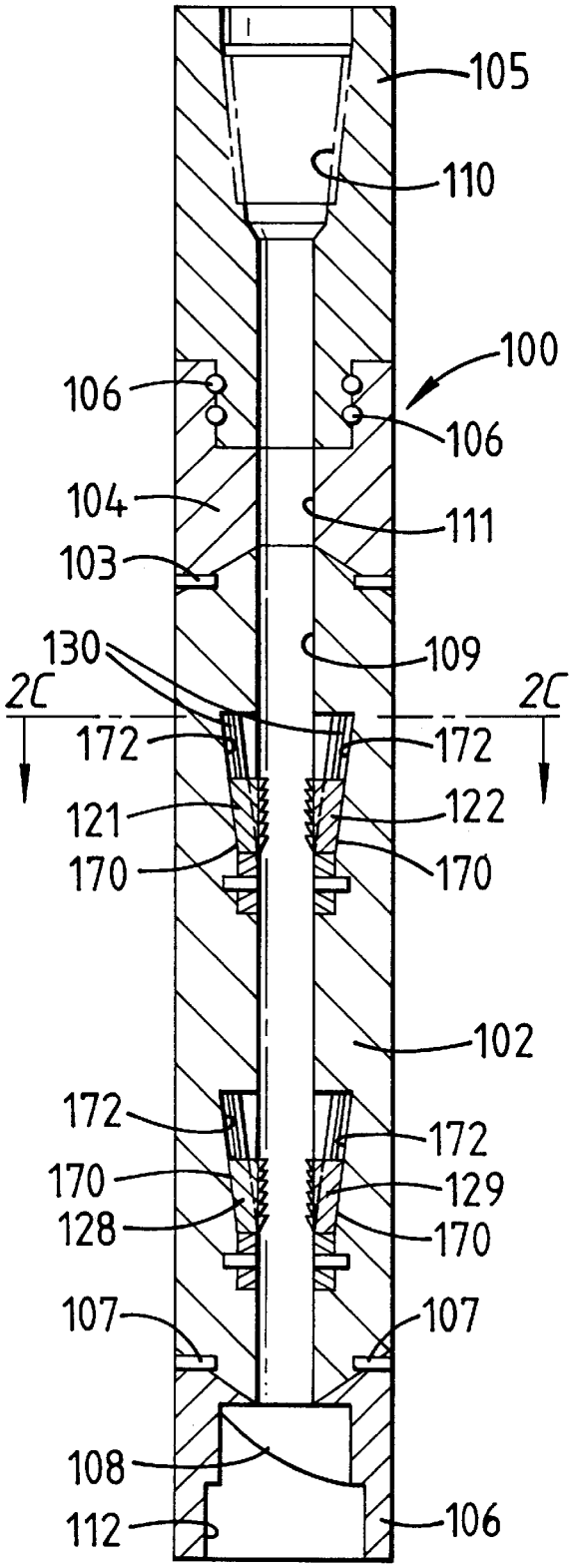

FIGS. 2A–2C show an overshot 100 according to the present invention with a body 102 secured with pins 103 to a rotatable member 104. The member 104 is rotatable with respect to an upper sub 105 on bearings 106 disposed between the bushing 104 and upper sub 105. The sub 105 and any hollow tubular(s) above it may "swallow" part of a collapsed coiled tubing.

A lower body 106 is secured with pins 107 to the body 102. A downwardly extending lip or profile 108 on the lower body 106 facilitates entry of a fish or collapsed tubing into a channel 109 that extends through the body 102. Fluid is flowable through the overshot 100 through a channel 110 of the upper sub 105, a channel 111 of the connector 104, the channel 109 of the body 102, and a channel 112 of the lower body 106. The body 102 is generally cylindrical as are the various channels mentioned above.

An upper slip pair 120 includes movable slip members 121 and 122 which are movable in chambers 123 and 124. Stop blocks 125, 126 secured to the body 102 with bolts or pins 138 hold the movable slip members on lips or rails 130 that project into recesses 127 on each slip. Lower slip members 128, 129 are like the slip members 121, 122 and move in chambers 163, 164. As shown in FIG. 2C, each movable slip member may have a serrated or toothed outer surface 140 to facilitate gripping of a fish or tubing.

As shown in FIG. 2A, the movable slip members 121, 122, 128, 129 are initially in an "up" position in their respective chambers. As the overshot 100 moves down and encounters and engages a fish or tubing, part of the fish or tubing moves up in the channel 109 and may move into the sub 105. Once the fish or tubing is gripped between the pairs of slips and an upward pull is applied to the overshot, the body 102 may move upwardly with respect to the fish or tubing therein. If the fish or tubing moves down with respect to the body 102, the movable slip members move down with the fish or tubing and, as they move down, their grip on the fish or tubing increases in force due to the generally inward movement of the movable slip members as they move down (see slip member position in FIG. 2B). The inward movement of the movable slip members is effected by the inclination of the lips or rails 130, the inclination of the slip chambers, and the corresponding inclined rear surface 170 of each slip and inclined inner surfaces 172 of each chamber.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. An overshot for engaging and retrieving a collapsed coiled tubing in a wellbore, the overshot comprising a body member with a top, a bottom, and a body channel therethrough from top to bottom, the body member having at least one slip chamber, at least one slip movably disposed in the at least one slip chamber of the body member, the at least one slip movable on at least one inclined rail in the at least one slip chamber so that, upon contacting the collapsed coiled tubing, upward movement of the body member results in downward movement of the at least one slip which also moves the at least one slip inwardly in the body member thereby increasing gripping force of the at least one slip on the collapsed coiled tubing.

2. The overshot of claim 1 wherein the at least one slip is two opposed slips, a first slip and a second slip opposite the first slip, each slip in a slip chamber in the body member, each slip movably mounted on at least one inclined rail.

3. The overshot of claim 2, the at least one slip further comprising a third slip and a fourth slip opposite the third slip and a fourth slip, each in a slip chamber in the body member and movably mounted on at least one inclined rail, the third and fourth slips lower than the first and second slips.

4. The overshot of claim 1 further comprising a bearing body connected to the body member, the bearing body rotatably connectible to another member between the body member and the another member.

5. The overshot of claim 1 wherein the at least one slip has a toothed outer gripping surface to facilitate gripping of the collapsed coiled tubing.

6. An overshot for engaging and retrieving a collapsed coiled tubing in a wellbore, the overshot comprising a body member with a top, a bottom, and a body channel therethrough from top to bottom, the body member having four slip chambers, two pairs of slips, one pair above the other, each slip movably disposed in the slip chamber of the body member, each slip movable on two inclined rails in its slip chamber so that, upon contacting the collapsed coiled tubing, upward movement of the body member results in downward movement of the slips which also moves the slips inwardly in the body member thereby increasing gripping force of the slips on the collapsed coiled tubing, and each slip removably held in its respective slip chamber by a releasable stop member, and each slip having a toothed outer gripping surface to facilitate gripping of the collapsed coiled tubing.

7. A method for engaging collapsed coiled tubing in a wellbore with an overshot, the method comprising introducing an overshot into a wellbore to contact the collapsed coiled tubing in the wellbore, the overshot comprising a body member with a top, a bottom, and a body channel therethrough from top to bottom, the body member having two slip chambers, two slips each movably disposed in each slip chamber of the body member, each slip movable on an inclined rail in a corresponding slip chamber so that, upon contacting the tubing, upward movement of the body member results in downward movement of the slips which also moves the slips inwardly in the body member thereby increasing gripping force of the slips on the collapsed coiled tubing, engaging the tubing with the overshot, and removing the overshot and tubing from the wellbore.

8. The method of claim 7 wherein a hollow sub is connected to the top of the overshot for receiving a portion of the collapsed coiled tubing and the method further comprising receiving a portion of the collapsed coiled tubing in the hollow sub.

* * * * *